United States Patent [19]

Petropoulos

[11] Patent Number: 4,718,123

[45] Date of Patent: Jan. 12, 1988

[54] COLD CLIMATE PROTECTIVE GARMENT

[76] Inventor: Chrissellene Petropoulos, 9201 Harrington Dr., Potomac, Md. 20854

[21] Appl. No.: 860,259

[22] Filed: May 6, 1986

[51] Int. Cl.[4] ..... A41D 23/00

[52] U.S. Cl. ..... 2/91

[58] Field of Search ..... 2/91, 201, 203, 207

[56] References Cited

U.S. PATENT DOCUMENTS

| | | | |
|---|---|---|---|
| D. 41,519 | 6/1911 | Way . | |
| D. 104,245 | 4/1937 | Delich . | |
| D. 108,019 | 1/1938 | O'Hara . | |
| D. 278,854 | 5/1985 | Protto . | |
| 766,963 | 8/1904 | Murray | 2/91 |
| 774,703 | 11/1904 | Scott | 2/91 |
| 783,867 | 2/1905 | Hymam . | |
| 828,967 | 8/1906 | Reichblum | 2/91 |
| 866,752 | 9/1907 | Way . | |
| 1,176,482 | 3/1916 | Orme | 2/91 |
| 3,105,970 | 10/1963 | Herzberg . | |
| 3,823,417 | 7/1974 | Cluckey | 2/91 |
| 4,495,660 | 1/1985 | Hayden | 2/91 |

FOREIGN PATENT DOCUMENTS

| | | | |
|---|---|---|---|
| 1423683 | 11/1965 | France | 2/91 |

*Primary Examiner*—Doris L. Troutman

*Attorney, Agent, or Firm*—Cushman, Darby & Cushman

[57] ABSTRACT

A garment made of virtually any woven fabric, completely homogeneous in construction includes a main body portion of the same general shape as that of the upper torso in that the bottom is narrower than the top. At the top of the garment are two directly opposed straight appendages that emanate from the main body at ninety degree angles. These appendages wrap around a user's neck and fasten to one another at the ends. At the top of the appendages and centered with the main body is an additional portion of fabric, semi-elliptical in shape.

12 Claims, 3 Drawing Figures

COLD CLIMATE PROTECTIVE GARMENT

BACKGROUND OF THE INVENTION

The inventor being an Opera singer and having lived in very cold climates, has discovered the indespensable need for total protection of ones vocal apparatus, encompassing the nose, mouth, chin, throat, neck and chest areas. Other professional singers, speakers, professors, or those in the speaking or communicating professions, also need protection from cold, drafts, or any changes in temperature to the nose, mouth, chin, throat, neck and chest areas. A conventional rectangular scarf and other prior art garments when wrapped around the neck, throat and chest provides protection only for those areas. The nose, chin, and mouth areas are still left unprotected. Only through a rewrapping of the scarf will any protection of the nose, chin and mouth areas be achieved. This will be at the expense of the previously covered areas in that they will now be left uncovered.

SUMMARY OF THE INVENTION

The invention is a very practical and aesthetic protection of the nose, mouth, chin, throat, neck and chest area. Both sexes of all ages find themselves needing this protection when subjected to cold temperatures and drafty conditions. The invention accomplishes this protection by simultaneously covering all of the nose, mouth, chin, throat, neck and chest. The invention is a garment made of virtually any woven fabric, i.e., wool, polyester, etc. and is completely homogeneous in construction. It can be manufactured to accomodate any standard or custom size. The simplicity of design allows standard manufacturing processes minimizing production costs and retail value.

DETAILED DESCRIPTION OF THE INVENTION

Figure 1:
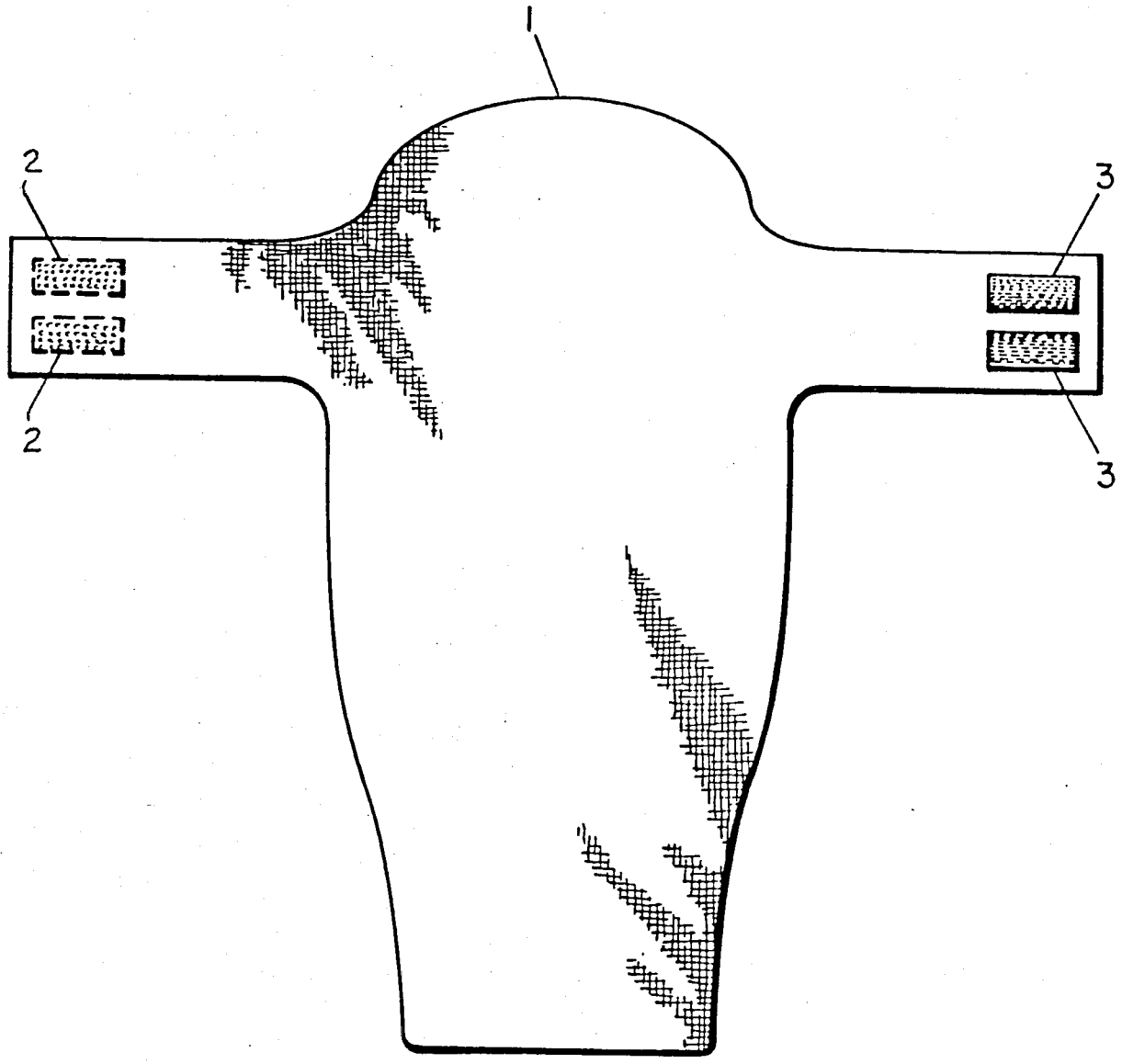
FIG. 1 is a front elevational view of the invention showing the appendages fully extended.

As shown in FIG. 1, the bottom of the main body portion of the invention is narrower than the top. This differential is achieved by flaring the fabric upward and then outward following curving lines from the bottom to the top. At the top are two directly opposed straight appnedages 10, which emanate from the main body 20 at 90° angles. These appendages are wrapped around the neck and fastened to one another at the ends via any type of releasable fasteners i.e., Velcro (trademark for nylon fabric configured to be fastened to itself) patches 30, 40 or other suitable connectors, such as buttons, zippers, snaps, etc. At the top of appendages 10 and centered with main body 20 is muffler element 50 comprising an additional portion of fabric, semi-elliptical in shape. Thus main body 20 is configured to protect the chest area, appendages 10 are configured to wrap around the neck thereby protecting the neck and throat and muffler element 50 protects the nose, mouth and chin.

Figure 2:
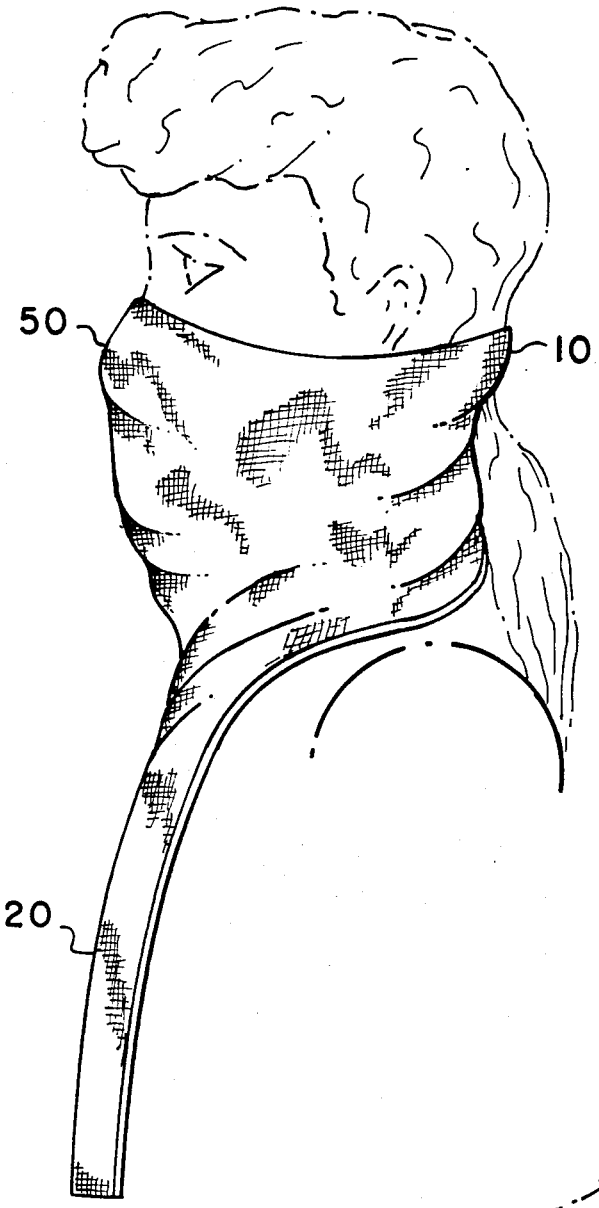
FIG. 2 is a profile of the invention in use.
Figure 3:
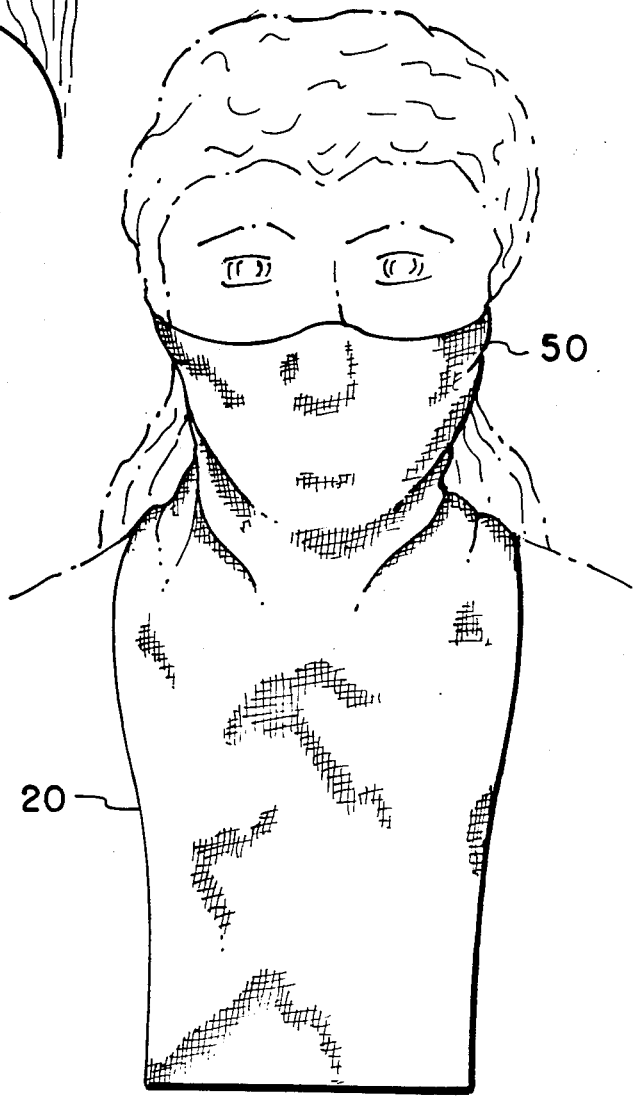
FIG. 3 is a frontal view of the invention in use.

FIGS. 2 and 3 illustrate how the invention is to be used, with Velcro fasteners 30, 40, carried on appendages 10, fastened behind the user's neck. The muffler element 50 is shown covering the nose, mouth and chin.

It should be appreciated that the above desribed description of the preferred embodiment does not limit the scope of the present invention in any way, and that various changes and modifications may be made without departing from the spirit and scope of the present invention.

Having thus fully described my invention, what I claim as new and desire to secure by Letters Patent is:

1. A garment for protecting a user's face, neck and upper torso areas from exposure to cold weather, said garment comprising:

a main body tapered at one end and substantially shaped to conform to an upper torso;

first and second appendages each having one end respectively attached at opposite sides of the other end of said main body and at substantially 90° from said main body, said appendages being of sufficient length to encircle the user's neck;

a semi-elliptical muffler element disposed between said appendages with the straight edge attached to the other end of said main body, said semielliptical muffler element when fully extended from said main body substantially covering the user's nose, mouth and chin; and mating fastening means disposed on the other ends of said appendages for securing said garment at the rear of the user's neck when said appendages encircle the user's neck.

2. The garment as in claim 1, said fastening means comprising Velcro fasteners.

3. The garment as in claim 1, said garment being made of woven material.

4. The garment as in claim 3, said woven material being any one of wool, polyester and wool/polyester blends.

5. The garment as in claim 1, said main body, first and second appendages and muffler element being integrally connected.

6. The garment as in claim 1, said main body, first and second appendages and muffler element being made from a single piece of woven material.

7. A garment for protecting a user's face, neck and upper torso areas from exposure to cold weather, said garment comprising:

a main body tapered at one end and substantially shaped to conform to an upper torso;

first and second appendages each having one end respectively attached at opposite sides of the other end of said main body, said appendages being of sufficient length to encircle the user's neck;

a muffler element disposed between said appendages and attached to and extending from the other end of said main body for substantially covering the user's face; and mating fastening means disposed on the other ends of said appendages for securing said garment to the user when said appendages encircle the user's neck;

said main body, first and second appendages and muffler element being made from a single piece of woven material.

8. The garment as in claim 7, said first and second appendages being disposed at substantially 90° from said main body and said muffler element being semi-elliptical in shape with the straight edge attached to said main body.

9. The garment as in claim 7, said fastening means comprising Velcro fasteners.

10. The garment as in claim 7, said garment being made of woven material.

11. The garment as in claim 10, said woven material being any one of wool, polyester and wool/polyester blends.

12. The garment as in claim 7, said main body, first and second appendages and muffler element being integrally connected.

* * * * *